US007487830B2

(12) United States Patent
Wolters et al.

(10) Patent No.: US 7,487,830 B2
(45) Date of Patent: Feb. 10, 2009

(54) METHOD AND APPARATUS TO FACILITATE WET OR DRY CONTROL LINE CONNECTION FOR THE DOWNHOLE ENVIRONMENT

(75) Inventors: Sebastiaan Wolters, Kingwood, TX (US); Adam Anderson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 213 days.

(21) Appl. No.: 10/702,529

(22) Filed: Nov. 5, 2003

(65) Prior Publication Data

US 2004/0159444 A1 Aug. 19, 2004

Related U.S. Application Data

(60) Provisional application No. 60/425,348, filed on Nov. 11, 2002.

(51) Int. Cl.
*E21B 17/18* (2006.01)

(52) U.S. Cl. ..... 166/242.6; 166/242.1

(58) Field of Classification Search ..... 166/88.1, 166/89.1, 88.4, 344, 347, 242.1, 242.6, 242.7; 251/210; 137/595
See application file for complete search history.

(56) References Cited

U.S. PATENT DOCUMENTS

| | | | | | |
|---|---|---|---|---|---|
| 2,990,851 | A * | 7/1961 | Jackson, Jr. et al. | ..... | 137/595 |
| 3,216,501 | A * | 11/1965 | Page, Jr. | ..... | 166/72 |
| 3,640,299 | A * | 2/1972 | Nelson | ..... | 137/1 |
| 4,095,613 | A * | 6/1978 | Townsend et al. | ..... | 239/738 |
| 4,125,155 | A * | 11/1978 | Brock, Jr. | ..... | 166/87.1 |
| 4,294,315 | A * | 10/1981 | Yonker et al. | ..... | 166/322 |
| 4,347,900 | A * | 9/1982 | Barrington | ..... | 166/380 |
| 4,418,750 | A * | 12/1983 | Paschal, Jr. | ..... | 166/214 |
| 5,217,071 | A | 6/1993 | Ferry et al. | ..... | 166/242 |
| 5,577,925 | A | 11/1996 | Schnatzmeyer et al. | ..... | 439/191 |
| 5,831,156 | A * | 11/1998 | Mullins | ..... | 73/152.18 |
| 6,098,710 | A * | 8/2000 | Rhein-Knudsen et al. | ... | 166/285 |
| 6,378,610 | B2 * | 4/2002 | Rayssiguier et al. | ..... | 166/281 |
| 2002/0112857 | A1 | 8/2002 | Ohmer et al. | ..... | 166/313 |

FOREIGN PATENT DOCUMENTS

| | | |
|---|---|---|
| FR | 2 742 795 | 12/1995 |
| WO | WO 00/57020 | 9/2000 |
| WO | WO 01/33032 A1 | 5/2001 |
| WO | WO 01/98632 A1 | 12/2001 |

* cited by examiner

*Primary Examiner*—Kenneth Thompson
(74) *Attorney, Agent, or Firm*—Cantor Colburn LLP

(57) ABSTRACT

A wet connect arrangement for communication beyond obstructions in a wellbore such as gravel packs and lateral junctions, among others. The arrangement employs communication line at first and second tubulars and annular or part annular communication pathways between the lines when the first and second tubulars are in operable position.

11 Claims, 8 Drawing Sheets

METHOD AND APPARATUS TO FACILITATE WET OR DRY CONTROL LINE CONNECTION FOR THE DOWNHOLE ENVIRONMENT

CROSS REFERENCE TO RELATED APPLICATIONS

This application claims the benefit of an earlier filing date from U.S. Provisional Application Ser. No. 60/425,348 filed Nov. 11, 2002, the entire disclosure of which is incorporated herein by reference.

BACKGROUND

Research over the last decade or more into efficient and reliable hydrocarbon recovery has led the industry to intelligent solutions to age old oil field (and other downhole industries) problems. Valving, sensing, computing, and other operations are being carried out downhole to the extent technology allows. Primary wellbores have "intelligent completion strings" installed therein that can zonally isolate portions of the well, variably control portions of the well and otherwise. These portions may be lateral legs of the well or different zones in the primary wellbore.

In multilateral wellbore structures, lateral legs can be very long and may pass through multiple producing and non-producing zones and may or may not be gravel packed. Both lateral legs and gravel packed zones, inter alia, create issues with regard to communication and control beyond these structures. Gravel packs have had communication pathways but they are difficult to align and work with; lateral legs are commonly controlled only at the junction with the primary wellbore because of difficulty in communicating past the junction.

Better communication beyond communication obstructing configurations would be beneficial to and well received by the hydrocarbon exploration and recovery industry.

SUMMARY

Disclosed herein is a control line wet connection arrangement including a first tubular having one or more control line connection sites associated therewith each site terminating at a port at an inside dimension of the first tubular, the inside dimension surface of the first tubular having a seal bore and a second tubular having one or more control line connection sites associated therewith, each line terminating at a port at an outside dimension of the second tubular, the outside dimension surface having at least two seals in axial spaced relationship to each other, at least one on each side of each port at the outside dimension of the second tubular.

Further disclosed herein is a multi-seal assembly having a seal body, a plurality of seals and a plurality of feed-through configurations for control lines. The feed-through configurations are staggered.

Disclosed herein is a junction configured to facilitate communication with a lateral completion string having a junction, a primary bore and a lateral bore intersecting the primary bore. At least one communication opening through the junction from a location outwardly of an inside dimension of the lateral bore into the lateral bore is provided.

A well system is also disclosed having a tubing string with a primary bore and at least one lateral bore extending from and intersecting the primary bore at a junction. The well system includes an intelligent completion string in the at least one lateral bore, and an intelligent completion string in the primary bore. A communication conduit is provided for each of the string in the primary bore and the at least one lateral bore, the communication conduit for the string in the at least one lateral bore being disposed outwardly of an inside dimension of the tubing string at least at the junction of the primary bore and the lateral bore.

Also disclosed herein is a method of installing intelligent completion strings in lateral legs of a wellbore. The method includes running a junction having a primary leg and a lateral leg on a tubing string to depth with an umbilical disposed outwardly of an inside dimension of the string and junction, the junction further having at least one opening from the umbilical to an inside dimension of the junction. The method also includes running an intelligent completion string into the lateral leg and connecting with the at least one opening.

Further disclosed herein is a connection arrangement for a first and second control line associated with first and second nestable tubulars including a first tubular having a first control line associated therewith, a second tubular having a second control line associated therewith and the first and second tubulars configured to when nested, isolate an annular volume to communicatively connect the first control line to the second control line.

BRIEF DESCRIPTION OF THE DRAWINGS

Referring now to the drawings wherein like elements are numbered alike in the several figures:

FIG. 9 is a schematic view of a multi-seal feed-through seal assembly with staggered feed-through;

DETAILED DESCRIPTION

Figure 1B:
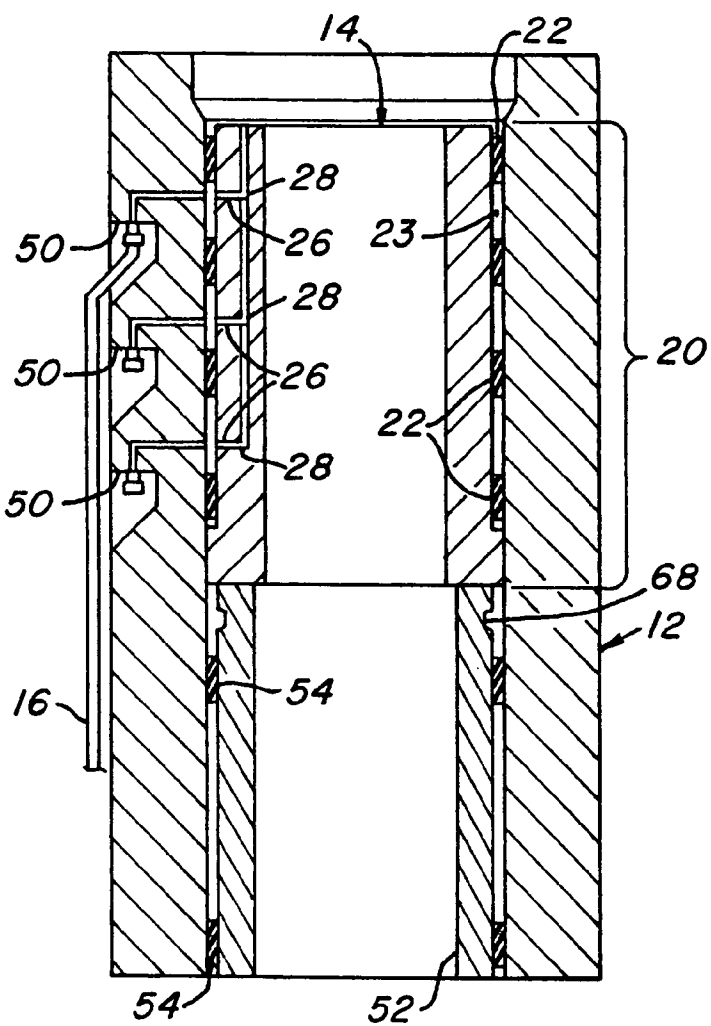
FIG. 1B is a schematic representation of a radial wet-connect connector in the post-connection condition.
Figure 1A:
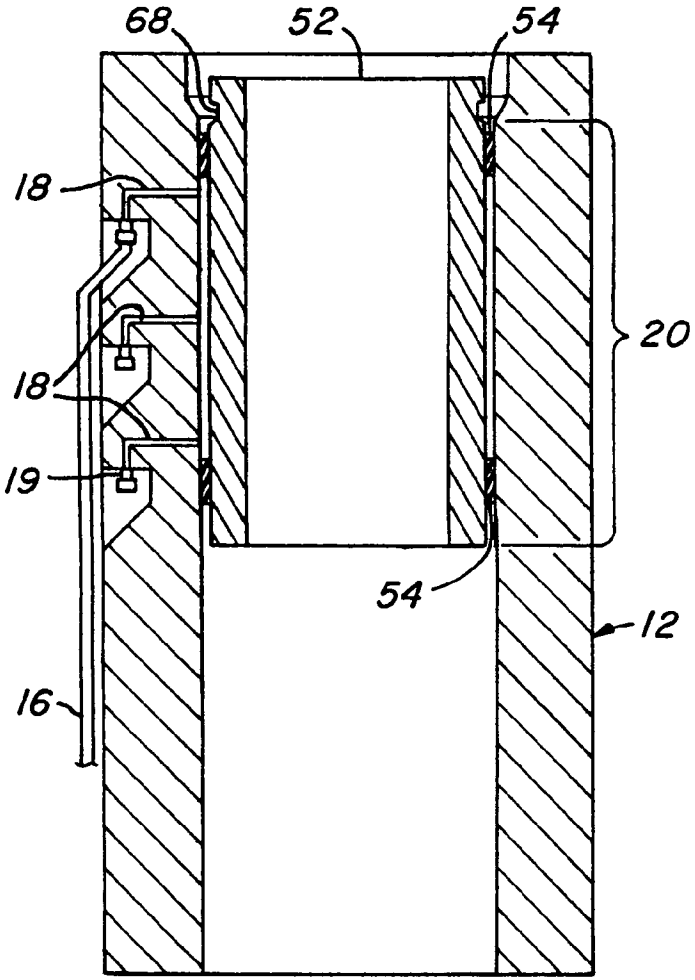
FIG. 1A is a schematic representation of a radial wet-connect connector in the pre-connection condition.

A hydraulic line wet connection arrangement is disclosed herein through two exemplary embodiments. For a better understanding of the arrangement however, the connection is first illustrated divorced from other devices. FIGS. 1A and 1B schematically illustrate just the connection itself in the pre-connection and post connection condition, respectively. A first tubular 12 has a larger inside dimension than a second tubular 14. Such that second tubular 14 can be received concentrically within first tubular 12, along with seals 22. There need be at least two seals in this arrangement to create an annular (or part annular, functioning similarly) sealed space 23 for communication between a control line uphole (not shown in this view), which may be hydraulic, and a control line downhole 16 which may be hydraulic. Ports 18 (three shown, any number is possible) in first tubular 12 extend from an inside dimension of first tubular 12, in a seal bore section 20 of the first tubular 12, to a control line connection site 19. Seal bore 20 is in one embodiment a polished bore. The control line connection site may be at an outside dimension of the first tubular 12 or may be between the outside dimension and inside dimension of the first tubular, the latter position being effected by providing a recess in the outside dimension surface of first tubular or by creating a control line termination at the site within the media of the first tubular 12. The ports 18 are spaced axially from one another and may be located anywhere circumferentially in the seal bore 20 at first tubular 12.

Second tubular 14 has a smaller outside dimension than the inside dimension of first tubular 12 so that it is possible to position second tubular 14 concentrically within first tubular 12. Second tubular 14 further includes at least two seals 22 axially spaced from one another sufficiently to allow a gap between the seals 22 about the size of a port 18. The outside dimension of second tubular 14 also is configured to facilitate interposition of seals 22 between the outside dimension of tubular 14 and the inside dimension of tubular 12. Four seals are illustrated in FIGS. 1A and 1B, which corresponds to the potential for connection of three individual control lines. This potential is realized if ports 18 are located in each annular space 23 bounded by seal bore 20, seals 22 and second tubular 14. Further, second tubular 14 would need to also have three ports 26 between respective seals 22 which ports 26 lead to control line connection sites 28 at second tubular 14. It should be appreciated that as many or as few control line connections can be effected as are desired, limited only by the ability to deliver control lines to the connection annuluses, which ability is a function of control line cross sectional area and total available area in the borehole particularly around the circumference of the tubulars 12 and 14.

In the embodiment of the connection device illustrated in FIGS. 1A and 1B, the seal bore 20 is a parallel surface to that of second tubular 14. Such configuration allows for mating of first tubular 12 and second tubular 14, thus effecting control line connection, without a pressure change in the respective control lines. This is desirable for some applications.

Figure 2B:
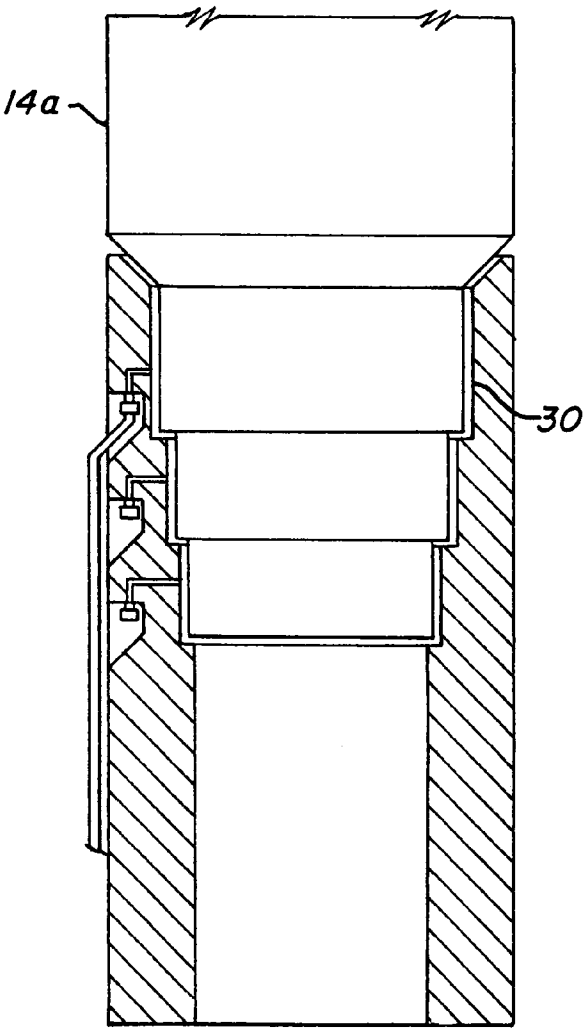
FIG. 2B is a representation similar to FIG. 1B but with a frustoconical connection geometry.
Figure 2A:
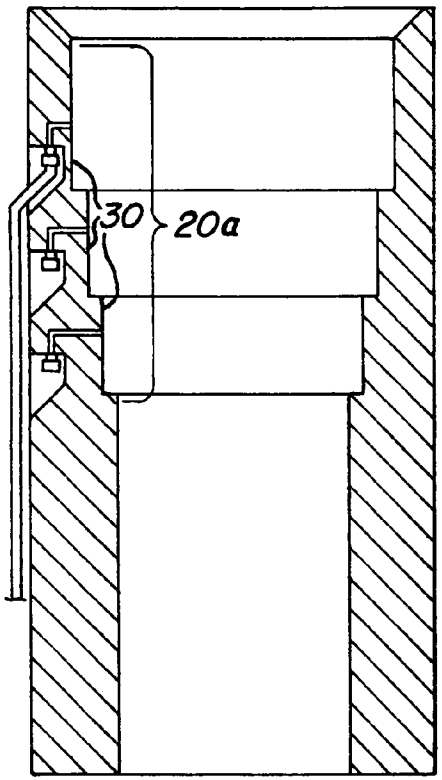
FIG. 2A is a representation similar to FIG. 1A but with a frustoconical connection geometry.

In another embodiment of the connection device, as illustrated in FIGS. 2A and 2B, the seal bore 20*a* is frustoconical in shape with a stepped surface 30. For this embodiment, second tubular 14*a* also has a frustoconical stepped shape complementary to the seal bore 20*a*. In this embodiment, ports located nearer the smallest outside dimension of second tubular 14*a* experience a larger pressure change upon connection than ports located nearer the largest outside dimension of second tubular 14*a*. In other respects the tool functions as does the foregoing embodiment.

Figure 3:
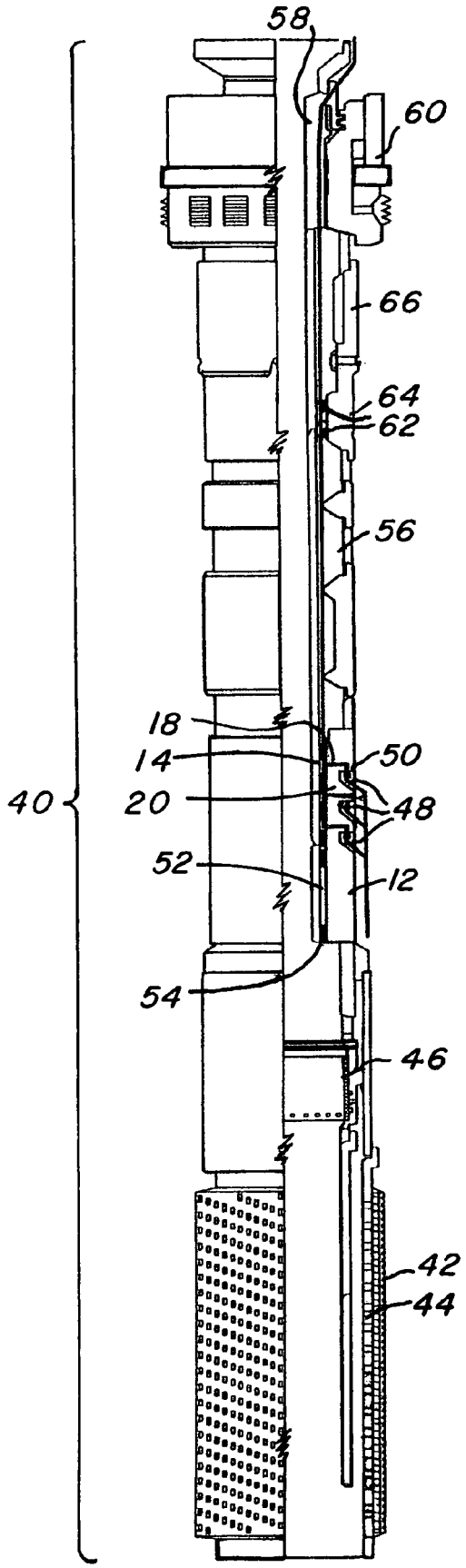
FIG. 3 is a schematic representation of a gravel pack configuration with the radial wet connector of FIGS. 1A and 1B.

Referring now to FIG. 3, one embodiment of a device employing the arrangement is illustrated. In this embodiment, the arrangement is employed with a gravel pack assembly 40. One of skill in the art will recognize screen 42, holed pipe 44 and sliding sleeve 46 as common portions of gravel pack assemblies. Other non-identified components are also common in the art. What is new is the arrangement for control line connection wherein the first tubular 12 as discussed above is in line with other gravel pack components. In this embodiment, three control line connection sites 48 are disposed in recesses 50. It should be appreciated that the individual connection sites may be employed for connection to a control line or may be left unconnected as desired. Clearly, at least one of the connection sites must be connected to a control line for control downhole vis-a-vis the wet connect arrangement disclosed herein to have an effect downhole of the arrangement. When sites are not used for connection to control lines they are advantageously capped or plugged in a suitable manner.

Prior to connection with a reconnect anchor 56, the ports as well as the seal bore 20 which in one embodiment is a polished bore, are protected by a wear bushing 52 with a pair of seals 54 to maintain the seal bore 20 and the ports 18 clean prior to mating with reconnect anchor 56.

Reconnect anchor 56 comprises second tubular 14 connected to an engagement tool 58 to engage gravel pack packer 60. Reconnect anchor 56 also supplies seals 62 at a downhole portion 64 of a gravel pack sliding sleeve 66. Upon advance of reconnect anchor 56 into first tubular 12, wear bushing 52 is pushed off seal bore 20 and second tubular 14 slides into engagement with seal bore 20. In one embodiment, visible only in FIGS. 1A and 1B, wear bushing 52 is provided with a retrieval latch 68 such that in the event anchor 56 is pulled, the wear bushing 52 is repositioned over seal bore 20 to prevent contamination thereof.

Figure 4:
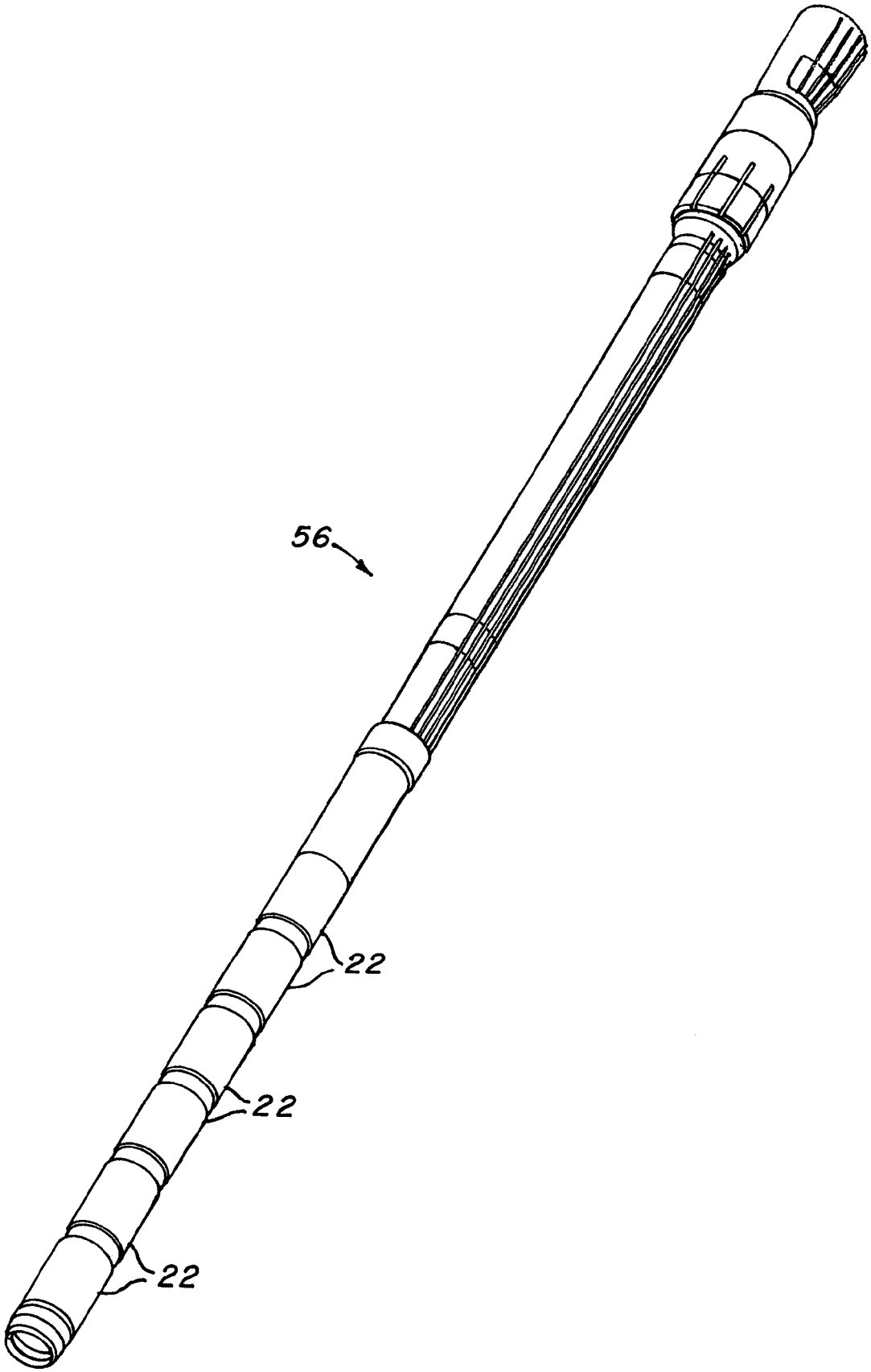
FIG. 4 is a perspective view of an anchor section of the radial wet connector.

Reference is also made to FIG. 4 providing a perspective view of the anchor 56.

In another configuration employing the wet connect concept and arrangement, the arrangement is employed to create communication between control lines above and below a junction.

Figure 5:
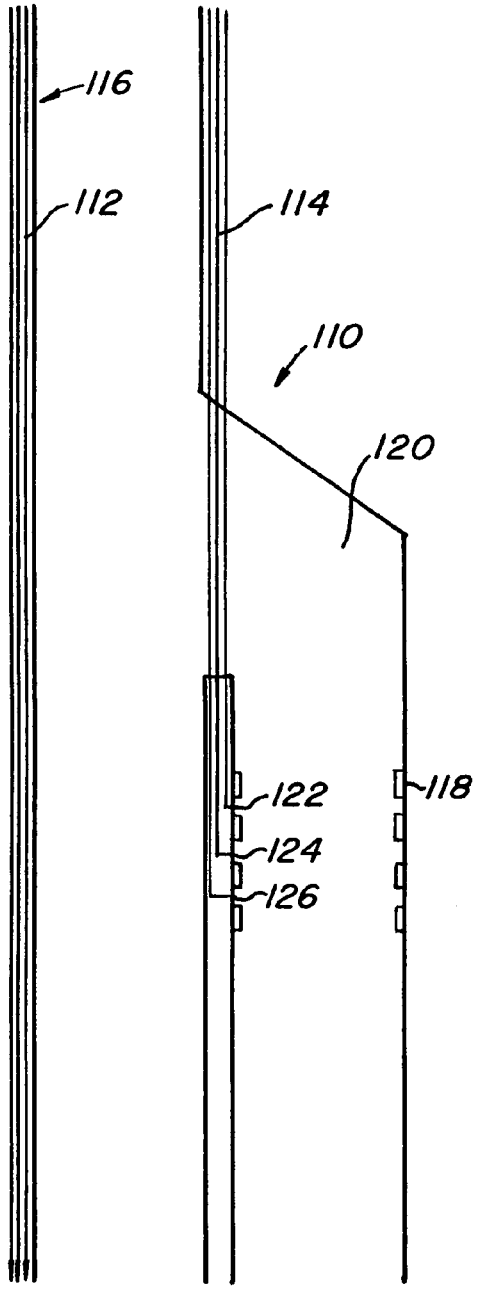
FIG. 5 is a schematic representation of a first embodiment of a multilateral junction configured to facilitate installation of an intelligent well system completion in both legs.

Referring to FIG. 5 a schematic representation of a multilateral junction 110 is endowed with one or more umbilicals or control lines 112, 114 (two shown, but may be more). Each individual umbilical (as noted above "control line" and "umbilical" are used interchangeably herein) may be employed to control independent devices or independent strings such as intelligent completion strings. This is particularly beneficial where the well has several lateral legs. One embodiment hereof will have the same number of umbilicals as legs, one to feed each. In the exemplary embodiment of FIG. 5, umbilical 112 continues down primary leg 116 while umbilical 114 ends at a multibore landing nipple or seal bore 118 (similar to seal bore 20 in previous discussed configuration) in an uphole end of lateral leg 120. In this example, umbilical 112 is intended to feed a more downhole device or lateral while umbilical 114 will feed the lateral leg (20) illustrated. It will now be clear to one of ordinary skill in the art that the arrangement as disclosed herein is stackable.

As illustrated, multibore landing nipple (or seal bore, these terms are used interchangeably herein) 118 includes three ports 122, 124 and 126 (more or fewer can be used depending upon axial length of landing nipple) which may be hydraulic ports, electrical ports, fiber optic ports or other types of communication ports singly or in combination such as where the control line is a combination including at least two of hydraulic, electrical and optical configurations depending upon the intended connection between the landing nipple and the tubing installed intelligent completion string. By providing umbilical 114 on the OD of junction 110, and providing connection via the landing nipple 118, the umbilical is not subjected to a Y-connection inside the tubing in order to connect to multiple lateral wellbores.

Drawing FIG. 5 illustrates each of three conductors of any type within umbilical 114 (it is noted that more or fewer conductors might be employed) are directed to a specific port 122, 124 or 126 within multibore landing nipple 118. Each of the ports 122, 124 and 126 may be open or covered in some manner. Open ports while effective if not contaminated, are susceptible to contamination by debris in a wellbore. One method of avoiding such contamination in hydraulic communication lines of the umbilical is to provide continuous application of positive pressure on each hydraulic line to avoid debris migration into the communication ports. It should also be noted as an ancillary matter that ports 122, 124 and 126 can act as a pneumatic pressure nozzle in order to inject gas into the fluid column. Alternatively, ports 122,124 and 126 may be physically closed to debris from drilling or well operations by provision of shear or rupture disks in each of the communication ports. These disks may be sheared or ruptured when desired through the controlled application of pressure on the umbilical from the surface or by mechanical, acoustic or electrical means. While shearing or rupturing may occur as desired at any time, it is envisioned that it will be more common to shear or rupture the disks after an intelligent completion string is tied back to the multibore landing nipple as is illustrated in FIG. 6.

Figure 6:
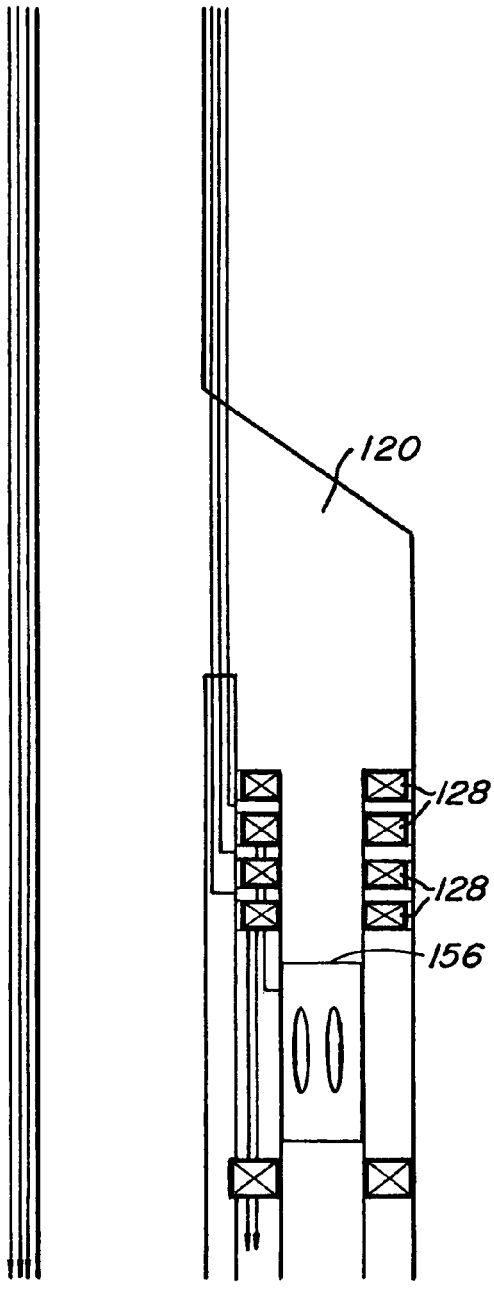
FIG. 6 is a view of the FIG. 5 multilateral junction with a schematically represented completion in the lateral leg.

Depicted in FIG. 6 is the same schematic diagram of a multilateral junction as is illustrated in FIG. 5, however, in FIG. 6 an intelligent well system completion has been installed in the lateral leg 120. One of skill in the art will recognize four packers 128 that interface with the multibore landing nipple to create three sealed passages into which ports 122, 124 and 126 (respectively) exit. Each of the sealed passages will of course have an exit route to the appropriate continuing conduit (see FIG. 10) through ports 123, 125 and 127 for operation of the intelligent well system completion.

Figure 7:
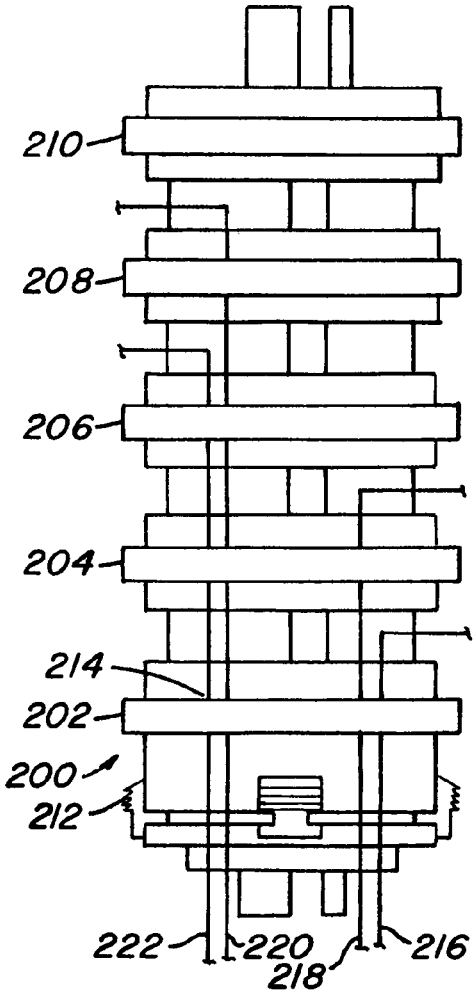
FIG. 7 is an enlarged view of a portion of the completion in FIG. 6.

Referring to FIG. 7, a multi-element feed-through packer is illustrated. The packer 200 is a single packer with multiple elements 202, 204, 206, 208 and 210. All of the elements are actuated by a common actuator, slips 212, etc. and only the elements are repetitious. Element 202 as shown has four feed-through locations 214. Element 204 has three feed-throughs; element 206, two feed-throughs, and element 208, one feed-through; thus are staggered. Feed-throughs rely on technology found in Premier Packers commercially available from Baker Oil Tools, Houston, Tex. As is appreciable by perusal of the figure each of the control lines 216, 218, 220 and 222 is terminated between different packing elements. This facilitates the communication as discussed above through the individual sealed annuluses created between packing elements.

As one of skill in the art will appreciate, a similar condition is achievable by employing multiple premier packers stacked atop each other. While this is functionally capable of achieving the desired result it unnecessarily duplicates components such as slips and actuators.

Figure 8:
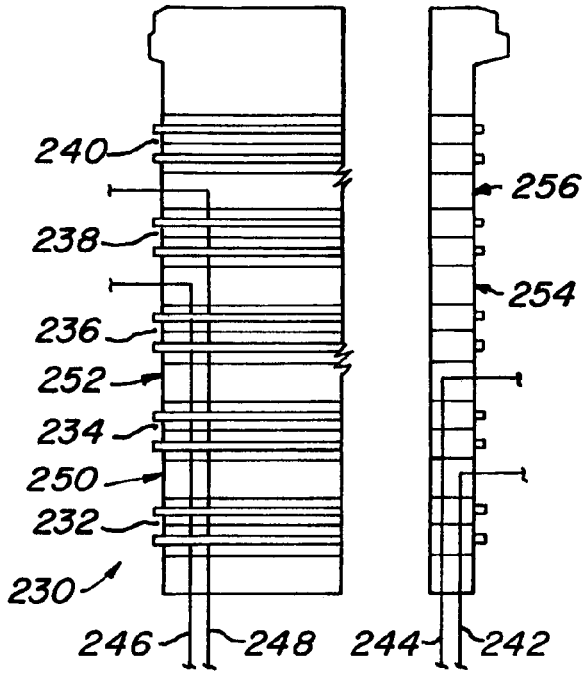
FIG. 8 is a schematic view of a multi-element staggered feed-through packer.

Referring to FIG. 8 an alternate device for achieving the goals of the system described herein is illustrated. Multi-seal feed-through seal assembly 230 is similar to packer 200 in that it provides multiple annular (or, as in the foregoing embodiment, part annular while functioning similarly) sealed areas for creating communication between for example (see FIGS. 5 and 10) ports 122, 124 and 126 to ports 123, 125 and 127. Multi-seal feed-through assembly 230 comprises a plurality of seals which as shown number 5, but more or fewer could be used. Seals 232, 234, 236, 238 and 240 are configured to provide annular sealed areas between each two seals. A control line enters each of these sealed areas as was the case in FIG. 7. In the case of FIG. 8, control lines 242, 244, 246, 248 feed through only as many elements as necessary to reach their respective annular sealed areas 250, 252, 254 and 256; thus are staggered.

It will be appreciated that conventional feed-through seal assemblies could be stacked to substitute for the device as disclosed herein but would unnecessarily duplicate components and thus would increase cost.

Figure 9:
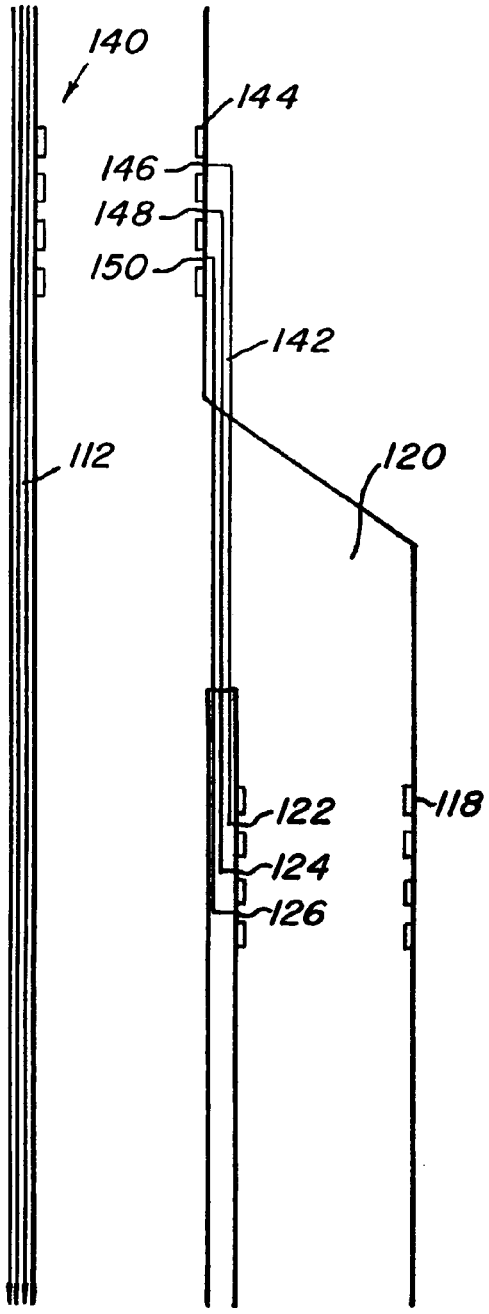
Figure 10:
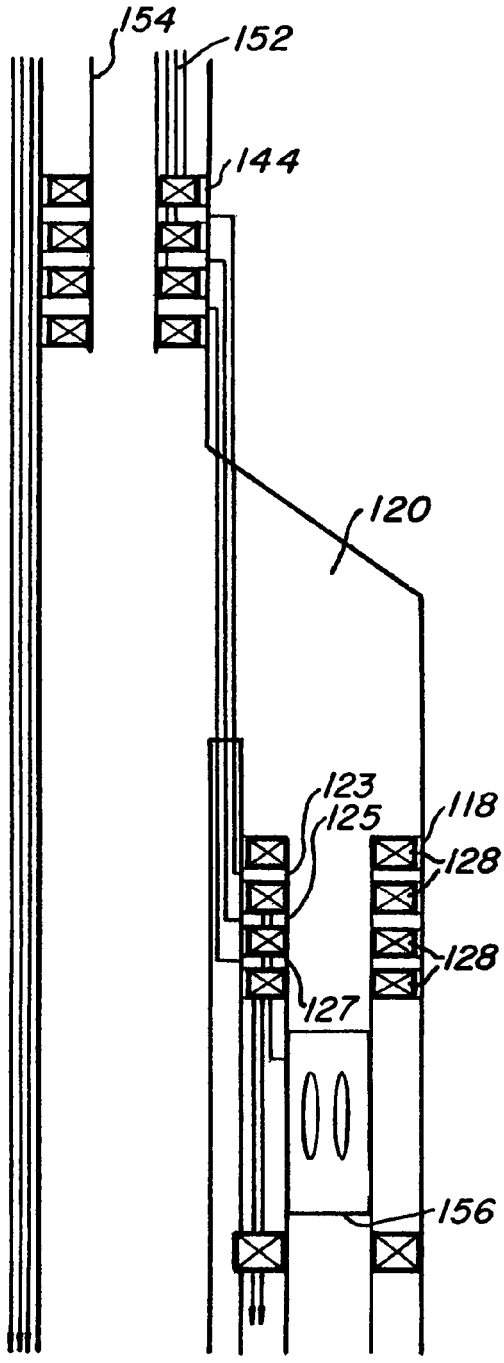
FIG. 10 is a schematic view of a second embodiment of a multilateral junction configured to facilitate installation of an intelligent well system completion in both legs.

Referring to FIGS. 9 and 10, an alternate embodiment is illustrated. The junction in this case illustrated as numeral 140 is similar to that of FIG. 5. Umbilical 112 is unchanged. It will be appreciated by one of ordinary skill in the art, however, that umbilical 114 in FIG. 5 does not go to surface and is indicated distinctly in this figure as numeral 142. Umbilical 142 terminates at a downhole end identically to FIG. 5 in multibore landing nipple 118. Distinct from the embodiment of FIG. 5, however, umbilical 142 terminates at its uphole end at multibore landing nipple 144. Landing nipple 144 includes ports 146, 148 and 150 which correspond respectively to ports 122, 124 and 126 to which they are connected by individual communication conduits of umbilical 142. Referring to FIG. 6, it will become apparent to one of ordinary skill in the art that another umbilical 152 to surface has been delivered downhole on string 154 and landed in nipple 144. String 154 communicates with landing nipple 144 identically to the way in which completion string 130 in FIG. 2 communicates with landing nipple 118 in FIG. 2. Once the string 154 has landed in landing nipple 144, umbilical 152 is connected to each of the ports 146, 148 and 150, and thereby to ports 122, 124, and 126, respectively for a continued communication pathway to the intelligent completion string 156 located in lateral 120.

In each of these embodiments, FIGS. 5, 6 and 9, 10, one of ordinary skill in the art will appreciate that the primary borehole 116 remains open while the lateral borehole 120 is completed with an intelligent string 156. Following the installation of the intelligent string 156 to the lateral borehole 120 a distinct intelligent string is deliverable down the primary wellbore. This string may deliver downhole its umbilical while it is being installed so the control is available over the primary completion string from a remote location without interference with the lateral completion string and without any Y-connections in the downhole environment.

Figure 11:
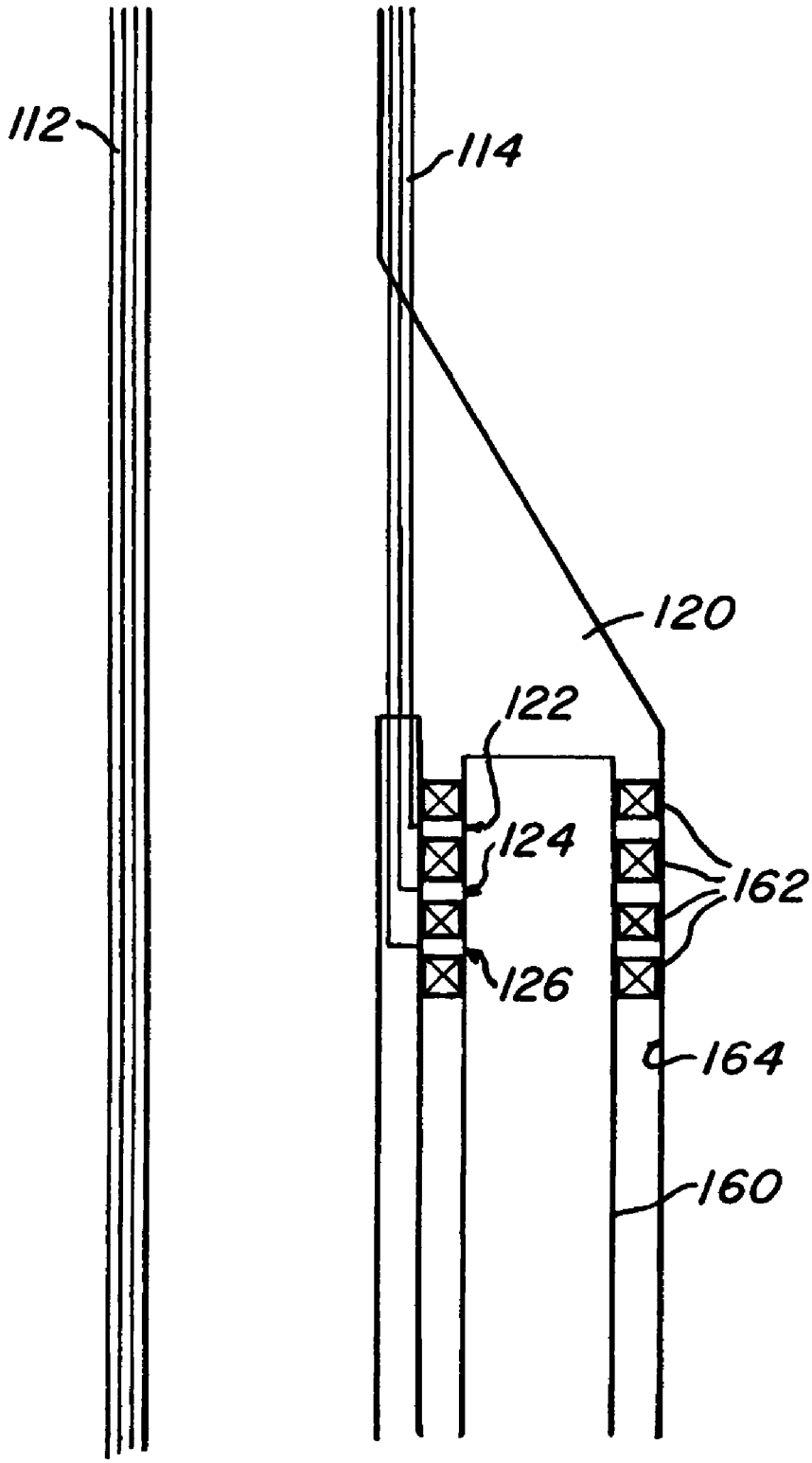
FIG. 11 is a view of the FIG. 7 multilateral junction with a schematically represented completion in the lateral leg.

Referring to FIG. 11 another embodiment is illustrated. One of ordinary skill in the art will appreciate the distinction between FIG. 9 and FIG. 5 wherein umbilical 114 extends as does that umbilical in FIG. 1 and terminates downhole in ports 122, 124 and 126. Clearly absent from the FIG. 9 illustration, however, is the multibore landing nipple illustrated in FIG. 5 as numeral 118. This embodiment is directed toward applications where no restriction in the inside diameter of the junction is permissible. In this case, the completion string 160 to be delivered to the lateral leg 120 will have a seal mechanism such as multiple packers 162 at the uphole end thereof to enable a pressure tight seal against the inside dimension 164 of bore 120 so that communication with the completion string may be had through ports 122, 124 and 126. In addition to the avoidance of any restriction in the ID of the lateral bore 120, this embodiment avoids potential damage to either the landing nipple or other components passing therethrough during installation of the completion string. In other respects, the embodiment of FIG. 11 operates as do the embodiments of FIGS. 5, 6 and 9, 10, all providing the capability of independently actuatable intelligent completion strings in the lateral bore and primary bore as well as being stackable for a true multilateral well system.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole control line wet connection arrangement comprising:

a first downhole tubular having one or more control line connection sites associated therewith each site terminating at a port at an inside dimension of the first tubular, the inside dimension surface of the first tubular having a seal bore;

protector disposed at the seal bore of the first downhole tubular, the protector being axially moveable upon engagement of the second downhole tubular with the first downhole tubular;

a second downhole tubular having one or more control line connection sites associated therewith, each line terminating at a port at an outside dimension of the second tubular, the outside dimension surface having at least two seals in axial spaced relationship to each other, at least one on each side of each port at the outside dimension of the second tubular.

2. A control line wet connection arrangement as claimed in claim 1 wherein the seal bore is cylindrical.

3. A control line wet connection arrangement as claimed in claim 1 wherein the seal bore is frustoconical.

4. A control line wet connection arrangement as claimed in claim 1 wherein said control line is hydraulic.

5. A control line wet connection arrangement as claimed in claim 1 wherein the connection site resides in a recess in an outside dimension surface of the first tubular.

6. A control line wet connection arrangement as claimed in claim 1 wherein the connection site is within the media of the first tubular.

7. A control line wet connection arrangement as claimed in claim 1 wherein the control line is electrical.

8. A control line wet connection arrangement as claimed in claim 1 wherein the control line is optical.

9. A control line wet connection arrangement as claimed in claim 1 wherein the control line is a combination including at least one of hydraulic, electrical and optical.

10. A control line wet connection arrangement as claimed in claim 1 wherein the control line is a combination including at least two of hydraulic, electrical and optical.

11. A downhole control line wet connection arrangement comprising:

a first downhole tubular having one or more control line connection sites associated therewith each site terminating at a port at an inside dimension of the first tubular, the inside dimension surface of the first tubular having a seal bore;

a second downhole tubular having one or more control line connection sites associated therewith, each line terminating at a port at an outside dimension of the second tubular, the outside dimension surface having at least two seals in axial spaced relationship to each other, at least one on each side of each port at the outside dimension of the second tubular, the arrangement being in operable communication with a gravel pack assembly.

* * * * *